US007171815B2

(12) United States Patent
Pathier et al.

(10) Patent No.: US 7,171,815 B2
(45) Date of Patent: Feb. 6, 2007

(54) OPERATIONAL METHOD FOR A CRYOGENIC TUNNEL (1)

(75) Inventors: Didier Pathier, Voisins le Bretonneux (FR); Alain Cloarec, Bois d'Arcy (FR); Robert Taylor, Wavre (BE)

(73) Assignee: L'Air Liquide, Societe Anonyme a Directoire Et Conseil de Surveillance pour l'Etude Et l'Exploitation des Procedes Georges Claude, Paris (FR)

( * ) Notice: Subject to any disclaimer, the term of this patent is extended or adjusted under 35 U.S.C. 154(b) by 186 days.

(21) Appl. No.: 10/507,147

(22) PCT Filed: Mar. 12, 2003

(86) PCT No.: PCT/FR03/00790

§ 371 (c)(1),
(2), (4) Date: Feb. 10, 2005

(87) PCT Pub. No.: WO03/081149

PCT Pub. Date: Oct. 2, 2003

(65) Prior Publication Data

US 2005/0126203 A1 Jun. 16, 2005

(30) Foreign Application Priority Data

Mar. 21, 2002 (FR) ..... 02 03512

(51) Int. Cl.
*F25D 13/06* (2006.01)

(52) U.S. Cl. ..... 62/63; 62/380

(58) Field of Classification Search ..... 62/63, 62/186, 266, 345, 374, 380, 381, 434; 198/401, 198/407, 774.1
See application file for complete search history.

(56) References Cited

U.S. PATENT DOCUMENTS 4,350,027 A * 9/1982 Tyree, Jr. ..... 62/374
4,403,479 A * 9/1983 Rasovich ..... 62/63
4,475,351 A * 10/1984 Klee ..... 62/63

(Continued)

FOREIGN PATENT DOCUMENTS

EP 93675 A * 11/1983

(Continued)

*Primary Examiner*—Mohammad M. Ali
(74) *Attorney, Agent, or Firm*—Elwood L. Haynes

(57) ABSTRACT

The invention is a method for operating a cryogenic tunnel through which products to be chilled or deep-frozen pass. This tunnel is equipped with means for injecting a cryogenic fluid and means for extracting the cold gases in the tunnel. The method includes obtaining an entry or an exit gas temperature from a gas temperature probe outside the tunnel in proximity to the tunnel entrance or exit. The method also includes obtaining an ambient temperature from an ambient temperature probe located outside the tunnel. The method also includes determining a first delta which is the difference between the ambient temperature and the gas temperature. And the method includes controlling the extraction rate of the extraction means by feedback as a function of the the temperature difference between the first delta and a set point, in order to restore the value of the first delta to the setpoint value if necessary.

25 Claims, 1 Drawing Sheet

U.S. PATENT DOCUMENTS

| | | | | | |
|---|---|---|---|---|---|
| 4,589,264 | A | * | 5/1986 | Astrom | 62/374 |
| 4,627,244 | A | * | 12/1986 | Willhoft | 62/63 |
| 4,739,623 | A | | 4/1988 | Tyree, Jr. et al. | |
| 4,745,762 | A | * | 5/1988 | Taylor | 62/63 |
| 4,783,972 | A | | 11/1988 | Tyree et al. | |
| 4,800,728 | A | * | 1/1989 | Klee | 62/63 |
| 4,947,654 | A | * | 8/1990 | Sink et al. | 62/186 |
| 4,955,206 | A | | 9/1990 | Lang et al. | |
| 5,605,049 | A | * | 2/1997 | Moore et al. | 62/63 |
| 5,878,582 | A | | 3/1999 | Appolonia et al. | |
| 6,094,924 | A | | 8/2000 | Viard | |
| 6,334,330 | B2 | * | 1/2002 | Lang et al. | 62/374 |
| 6,434,950 | B2 | * | 8/2002 | Newman et al. | 62/63 |
| 6,553,781 | B2 | * | 4/2003 | Taylor | 62/380 |
| 6,725,686 | B2 | * | 4/2004 | Miller | 62/374 |

FOREIGN PATENT DOCUMENTS

| | | |
|---|---|---|
| EP | 0 667 503 | 8/1995 |
| FR | 2 765 674 | 1/1999 |

* cited by examiner

OPERATIONAL METHOD FOR A CRYOGENIC TUNNEL (1)

BACKGROUND

The present invention relates to a method and a device for operating a cryogenic tunnel, which tunnel is of the type through which products to be chilled or deep-frozen pass and is equipped with means for injecting a cryogenic fluid as well as means for extracting the cold gases resulting from the vaporization of the fluid in the tunnel at a variable rate.

A cryogenic tunnel is an open system through which products pass, which are intended to be chilled or deep-frozen by injecting generally liquid nitrogen or some other cryogenic fluid which needs to be removed from the system in the form of a gas after vaporization.

The tunnel has an opening through which the products can enter and an opening through which the products can leave.

The cryogenic liquid enters the tunnel through one or more pipes.

One or more additional openings are generally dedicated to extracting the cold gases resulting from the vaporization of the fluid in the tunnel, which therefore entails pumping out the gases containing a large proportion of nitrogen and discharging them to the external surroundings.

In ideal operation, the gas flows should be balanced as follows:

- Extraction rate=flow rate of nitrogen gas generated by the liquid nitrogen injection.
- Product exit side: air intake rate zero, and gas release rate also zero.
- Product entry side: ditto i.e. air intake rate zero and gas release rate both zero.

It is virtually impossible to obtain such ideal operation in practice and, in particular, it is very difficult to control the following two aspects in a consistent way:

- Matching the extraction rate to the volume of nitrogen gas generated: the quantity of nitrogen injected into the tunnel is variable in practice, and it may therefore be difficult to make the extraction keep pace with the requirements.
- Balancing the gases between the entry and the exit of the tunnel: a tunnel may have a slightly negative pressure on the product exit side and a slightly positive pressure on the product entry side if the extraction rate is matched correctly, even though the situation may become reversed a moment later.

Various approaches have therefore been proposed in order to provide solutions to the problems listed above.

Most frequently, "over-extraction" is performed in order to prevent releases of gas (and therefore leaks of nitrogen into the production premises).

This typically involves extraction at a fixed rate, which is calculated with a large safety margin relative to the maximum requirements of the tunnel, with suction hoods being located at the entry and exit of the tunnel.

The following characteristics are observed in such a case:

- the extraction rate is much more than the flow rate of nitrogen gas generated by the liquid nitrogen injection.
- Product exit side: the air intake rate is much more than 0, while the gas release rate is almost zero.
- Product entry side: ditto i.e. an air intake rate much more than 0, while the gas release rate is almost zero.

It will therefore be understood that the advantage of this technical solution is that the risk of anoxia (cumulative nitrogen leaks in the production premises leading to a reduced level of oxygen in the room) is low when the tunnel is started up, but its drawback is associated with the large intakes of air which cause moisture to enter the tunnel. On the inside, the equipment therefore ices up rapidly and loses its efficiency. This intake of air also leads to an over-consumption of nitrogen.

It should be noted that these intakes of air also cause moisture to enter the extraction lines, and therefore the creation of ice in them. After several hours of operation, this ice may obstruct the extraction lines and lead to nitrogen leaks from the tunnel due to lack of extraction (whence a risk of anoxia).

Another solution encountered quite frequently in the industry, in order to limit the intakes of air and releases of gas, is one according to which the extraction is only slightly more than required ("slight over-extraction"). This is often the best compromise which can be found in the state of the art.

According to this solution, extraction is performed at a fixed rate which is calculated to be just above the maximum requirements of the tunnel, or alternatively variable-rate extraction indexed to the degree of opening of cock letting liquid nitrogen into the tunnel.

The following characteristics are observed in such a case:

- the extraction rate is more than the flow rate of nitrogen gas generated by the liquid nitrogen injection.
- product exit side: the air intake rate is slightly positive, with greater or lesser variations according to the operating phases of the tunnel, while the gas release rate is slightly negative on average, here again with greater or lesser variations according to the operating phases of the tunnel.
- product entry side: here again the air intake rate is slightly positive on average, while the gas release rate is slightly negative on average.

It can therefore be seen that the balance between the exit and the entry of the tunnel may vary over time, and that an observable situation in which gases are released from the entry of the tunnel and air is taken in at the exit of the tunnel may change to a situation in which air is taken in at the entry of the tunnel and gases are released from the exit of the tunnel.

It will therefore be understood that the advantage of this "slight over-extraction" solution is that the risk of anoxia is quite low when the tunnel is started up, while its major drawback, just as in the case of over-extraction, is associated with the fact that the intake of air causes icing of the equipment and of the extraction lines, and an over-consumption of nitrogen. The air intake rate, however, is low and the technical drawbacks listed above are then more or less limited depending on the case.

A last approach may also be mentioned, although it is almost never employed in practice, which involves using reduced pumping in order to limit the intakes of air ("under-extraction").

The following characteristics are observed in such a case:

- an extraction rate less than the flow rate of nitrogen gas generated by the liquid nitrogen injection.
- product exit side: an almost zero air intake rate, while the gas release rate is positive.
- product entry side: again, an almost zero air intake rate with a positive gas release rate.

The advantage of the situation is indeed that no air is taken in at the entry and exit of the tunnel. No ice is therefore deposited in the equipment and in the extraction lines, and there is no over-consumption of nitrogen due to possible intakes of hot air.

But it is quite clearly dangerous to operate a tunnel under these conditions. The leaks of nitrogen to the outside of the tunnel entail a risk of anoxia and therefore a situation which is dangerous for the personnel working nearby.

The above discussion therefore demonstrates the genuine need to be able to provide a solution that offers a better compromise for this industry, making it possible to work closer to the ideal equilibrium. To that end:

the extraction rate should be matched to the volume of nitrogen gas which is generated. Since the quantity of nitrogen injected into the tunnel is variable, the extraction rate should also keep pace with the requirements as accurately as possible while allowing for the possible lags between the injection of liquid nitrogen and the moment when it vaporizes.

concerning the balance of the gases between the entry and exit of the tunnel: the system should make it possible to guide the gases in order to prevent them being released from either the entry or the exit of the tunnel.

all these checks are preferably automatic without any human intervention other than fixing the initial settings.

With such balancing of the gases in the tunnel and an extraction which is fully matched to the requirements, the tunnel would thus no longer take air in (either at the entry or at the exit) and could therefore operate for a longer time without de-icing and without losing its efficiency. The extraction lines would no longer be obstructed, and the leaks of nitrogen would at the very least be significantly reduced or even eliminated. This would overcome the risk of anoxia.

The approach of Document U.S. Pat. No. 5,878,582 may also be mentioned, which attempts to control a cryogenic chamber by comparing a temperature value at the external entry of the tunnel with a setpoint, and by feedback control of the extraction means of the chamber according to the result of this comparison.

The Applicant has been able to show that although this technical approach offers certain improvements over the prior-art approaches mentioned above, it is still unsatisfactory quite simply because it does not take account of the ambient temperature in the premises where the cryogenic chamber is operating.

Specifically, the setpoint temperature should be close to the ambient temperature in order to obtain good results according to this document, while always remaining lower than it. This is because if the setpoint becomes higher than the ambient temperature (since the ambient temperature has fallen), then the system becomes inoperable because the extraction will accelerate endlessly but without ever being able to reach this setpoint temperature. It will be impossible to increase the measured temperature above the temperature of the ambient air. In short, the system can be controlled easily according to this technique if the ambient temperature in the premises is relatively stable (plus or minus one degree), but when the temperature of the premises varies (which is often the case in food production premises) then this control technique may become inefficient or occasionally inoperable (setpoint temperature becoming higher than the ambient temperature).

In one aspect of the present invention a method for operating a cryogenic tunnel through which products to be chilled or deep-frozen pass is provided. This tunnel is equipped with means for injecting a cryogenic fluid as well as means for extracting, at a variable rate, some of the cold gases resulting from the vaporization of the fluid in the tunnel. The method includes obtaining a gas temperature, wherein this gas temperature comprises a value selected from the group consisting of the temperature of the gases in proximity to the entry to the tunnel, and the temperature of the gases in proximity to the exit to the tunnel, wherein this gas temperature is obtained from at least one gas temperature probe which is provided outside the tunnel, at a location selected from the group consisting of proximity to the tunnel entrance, and proximity to the tunnel exit. The method also includes obtaining an ambient temperature, wherein this ambient temperature is obtained from at least one ambient temperature probe which is provided outside the tunnel. The method also includes determining a first delta, wherein this first delta is the difference between the ambient temperature and the gas temperature. The method also includes comparing the value of the first delta with a first setpoint value. And the method includes controlling the extraction rate of the extraction means by feedback as a function of the result of the comparison in step d), in order to restore the value of the first delta to the setpoint value if necessary.

In this context, the invention relates to a method for operating a cryogenic tunnel through which products to be chilled or deep-frozen pass, which tunnel is equipped with means for injecting a cryogenic fluid as well as means for extracting, at a variable rate, some or all of the cold gases resulting from the vaporization of said fluid in the tunnel, characterized in that:

a) at least one temperature probe is provided outside the tunnel, in proximity to its entry and/or its exit, which is capable of providing a value $T_{entry/exit}$ of the temperature of the gases at the point where it is located;

b) at least one temperature probe is provided outside the tunnel, which is capable of providing a value $T_{amb}$ of the ambient temperature of the premises where the tunnel is operating;

c) the difference $T_{amb\text{-}entry/exit}$ between said ambient temperature $T_{amb}$ and said temperature $T_{entry/exit}$ is determined, or alternatively the difference between the average of the ambient temperatures which are provided by said ambient temperature probes and the average of said temperatures $T_{entry/exit}$ which are provided by said entry/exit temperature probes;

d) the value of the temperature difference provided by step c) is compared with a predetermined setpoint value $T^{0}_{amb\text{-}entry/exit}$;

e) the extraction rate of said extraction means is controlled by feedback as a function of the result of the comparison in step d), in order to restore the value of said temperature difference to said setpoint value $T^{0}_{amb\text{-}entry/exit}$ if necessary.

The Applicant has therefore demonstrated the fundamental importance of taking into account the ambient temperature of the premises where the tunnel is operating, in order to obtain high-quality operation. It can be seen that the ambient temperature probe should preferably be arranged at a position where the temperature is not influenced by the tunnel or by any other machine or ventilation system which may be present in the premises in question.

The operating method according to the invention may furthermore adopt one or more of the following technical features:

regulation of the PID type is used in order to carry out said feedback in step e).

one or more gas equilibration valves are provided inside the tunnel, which is/are capable of directing the cold gases to the entry or the exit of the tunnel and can be actuated automatically from outside the tunnel.

in the case when said valves are present:

i) at least one temperature probe is provided outside the tunnel, in proximity to its exit, which is capable of providing a value $T_{exit}$ of the temperature of the gases at the point where it is located, and at least one temperature probe is provided outside the tunnel, in proximity to its entry, which is capable of providing a value $T_{entry}$ of the temperature of the gases at the point where it is located;

j) the difference $T_{exit-entry}$ between said temperature $T_{exit}$ and said temperature $T_{entry}$ is determined, or the difference between the average of the temperatures $T_{exit}$ which are provided by said exit temperature probes and the average of said temperatures $T_{entry}$ which are provided by said entry temperature probes;

k) the value of the temperature difference provided by step j) is compared with a predetermined setpoint value $T^0_{exit-entry}$;

l) the orientation of some or all of said equilibration valves is controlled by feedback as a function of the result of the comparison in step k), in order to direct some or all of the cold gases contained in the tunnel so as to restore the value of said temperature difference to said setpoint value $T^0_{exit-entry}$ if necessary.

regulation of the PID type is used in order to carry out said feedback in step l).

said extraction means on which the feedback is carried out comprise a single extraction line located inside the tunnel, substantially above the region where the products enter.

The invention also relates to a device for operating a cryogenic tunnel through which products to be chilled or deep-frozen pass, which tunnel is equipped with means for injecting a cryogenic fluid as well as means for extracting, at a variable rate, some or all of the cold gases resulting from the vaporization of said fluid in the tunnel, comprising:

a) at least one temperature probe located outside the tunnel, in proximity to its entry and/or its exit, which is capable of providing a value $T_{entry/exit}$ of the temperature of the gases at the point where it is located;

b) at least one temperature probe located outside the tunnel, which is capable of providing a value $T_{amb}$ of the ambient temperature of the premises where the tunnel is operating;

c) a data acquisition and processing unit capable of determining the difference $T_{amb-entry/exit}$ between said ambient temperature $T_{amb}$ and said temperature $T_{entry/exit}$, or alternatively the difference between the average of the ambient temperatures which are provided by said ambient temperature probes and the average of said temperatures $T_{entry/exit}$ which are provided by said entry/exit temperature probes, of comparing the value of the temperature difference provided by the previous step with a predetermined setpoint value $T^0_{amb-entry/exit}$, and of optionally controlling the extraction rate of said extraction means by feedback as a function of the result of the previous comparison, in order to restore the value of said temperature difference to said setpoint value $T_{amb-entry/exit}$ if necessary.

The operating device according to the invention may furthermore adopt one or more of the following technical features:

the data acquisition and processing unit uses a regulator of the PID type in order to carry out said feedback.

the device comprises one or more gas equilibration valves inside the tunnel, which is/are capable of directing the cold gases to the entry or the exit of the tunnel and can be actuated automatically from outside the tunnel.

in the case when said valves are present, the device also comprises:

i) at least one temperature probe located outside the tunnel, in proximity to its exit, which is capable of providing a value $T_{exit}$ of the temperature of the gases at the point where it is located, and at least one temperature probe located outside the tunnel, in proximity to its entry, which is capable of providing a value $T_{entry}$ of the temperature of the gases at the point where it is located;

j) a data acquisition and processing unit capable of determining the difference $T_{exit-entry}$ between said temperature $T_{exit}$ and said temperature $T_{entry}$, or the difference between the average of the temperatures $T_{exit}$ which are provided by said exit temperature probes and the average of said temperatures $T_{entry}$ which are provided by said entry temperature probes, of comparing the value of the temperature difference provided by the previous step with a predetermined setpoint value $T^0_{exit-entry}$, and of optionally controlling the orientation of some or all of said equilibration valves by feedback as a function of the result of the comparison in step k), in order to direct some or all of the cold gases contained in the tunnel so as to restore the value of said temperature difference to said setpoint value $T^0_{exit-entry}$ if necessary.

said data acquisition and processing unit uses a regulator of the PID type in order to carry out said feedback.

said extraction means on which the feedback is carried out comprise a single extraction line located inside the tunnel, substantially above the region where the products enter.

The invention also relates to a cryogenic tunnel which incorporates such operating means as described above.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

In one aspect of the present invention a method for operating a cryogenic tunnel through which products to be chilled or deep-frozen pass is provided. This tunnel is equipped with means for injecting a cryogenic fluid as well as means for extracting, at a variable rate, some of the cold gases resulting from the vaporization of the fluid in the tunnel. The method includes obtaining a gas temperature, wherein this gas temperature comprises a value selected from the group consisting of the temperature of the gases in proximity to the entry to the tunnel, and the temperature of the gases in proximity to the exit to the tunnel, wherein this gas temperature is obtained from at least one gas temperature probe which is provided outside the tunnel, at a location selected from the group consisting of proximity to the tunnel entrance, and proximity to the tunnel exit. The method also includes obtaining an ambient temperature, wherein this ambient temperature is obtained from at least one ambient temperature probe which is provided outside the tunnel. The method also includes determining a first delta, wherein this first delta is the difference between the ambient temperature and the gas temperature. The method also includes comparing the value of the first delta with a first setpoint value. And the method includes controlling the extraction rate of the extraction means by feedback as a function of the result of the comparison in step d), in order to restore the value of the first delta to the setpoint value if necessary.

Figure 1:
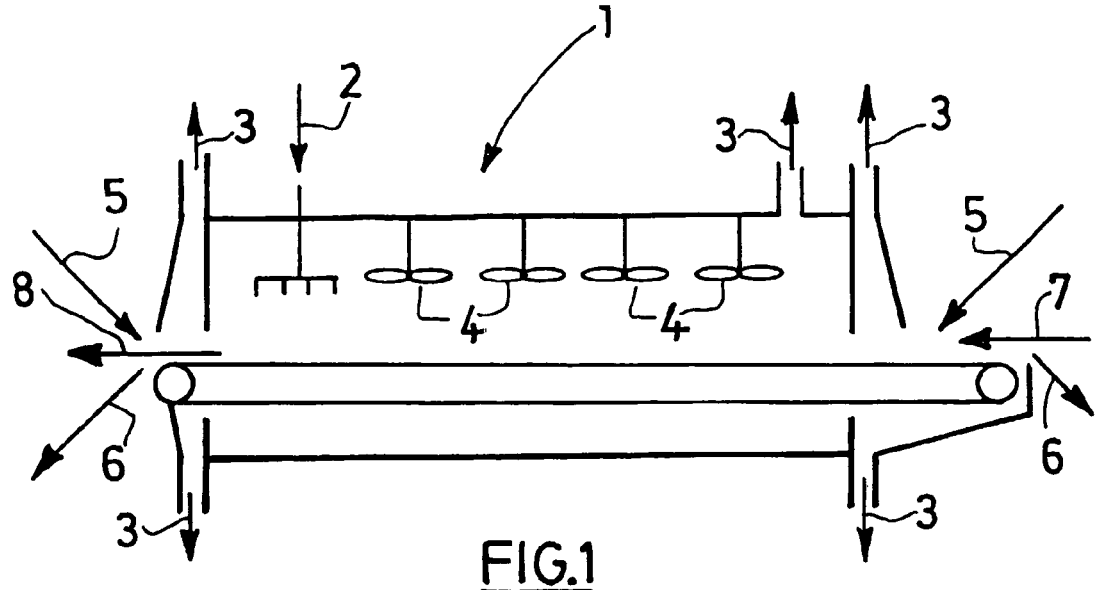
FIG. 1 illustrates a stylized view of a prior-art tunnel in longitudinal section.

FIG. 1 illustrates the typical structure of a cryogenic tunnel 1 through which products to be chilled or deep-frozen pass (product entry 7, processed-product exit 8), which tunnel is equipped with means 2 for injecting a cryogenic fluid as well as one or more means 3 for extracting the cold gases resulting from the vaporization of said fluid in the tunnel. The presence of a series of fans 4 is furthermore shown.

The arrows 5 also represent the intakes of air into the tunnel (at the entry or exit) and the arrows 6 represent the releases of gas from the tunnel (also at the entry or exit).

Figure 2:
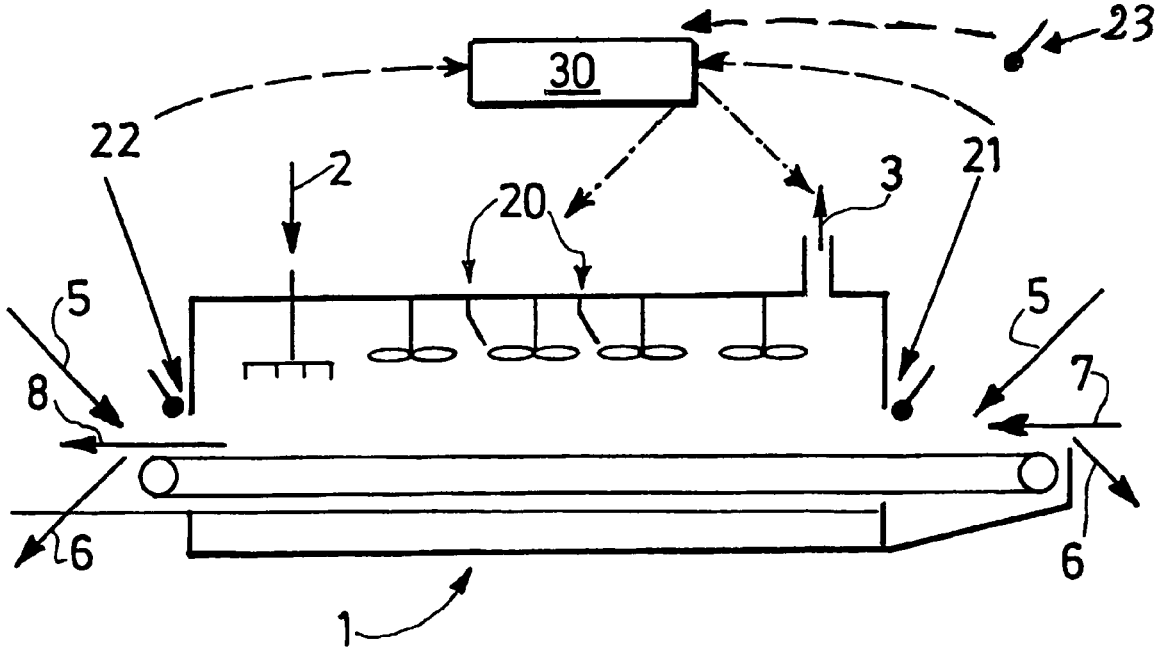
FIG. 2 illustrates a stylized view in longitudinal section of a tunnel for carrying out the invention.

The installation represented in FIG. 2 in turn makes it possible to carry out the present invention. It will be noted that structural elements that are the same as in FIG. 1 have the same reference (for example the injection of cryogenic liquid 2, or the intakes of air 5 into the tunnel or the releases of gas 6 from this tunnel).

In the embodiment which is represented, a temperature probe 21 is provided outside the tunnel in proximity to its entry, which is capable of providing a value $T_{entry}$ at the point where it is located, a temperature probe is provided outside the tunnel in proximity to its exit, which is capable of providing a value $T_{exit}$ of the temperature of the gases at the point where it is located, and a temperature probe 23 is provided outside the tunnel, which is capable of providing a value $T_{amb}$ of the ambient temperature of the premises where the tunnel is operating.

The notion of "proximity" with respect to one or other of the probes according to the invention should be understood as meaning a reasonable distance so that the delivered temperature value is representative of the air intake phenomena or cold-gas leakage phenomena, and, typically, an order of magnitude of from a few millimeters to a few tens of millimeters from the entry or exit door of the tunnel will therefore be very suitable for carrying out the present invention.

As indicated in the figure, a data acquisition and processing unit 30 is also provided (see the dashed and dot-and-dash arrows in the figure) which is capable:

- of determining the difference $T_{amb\text{-}entry/exit}$ between the ambient temperature $T_{amb}$ provided by the probe 23 and one or other of the temperatures $T_{entry/exit}$ provided by the probes 21 and 22, or their average;
- of comparing the value of the temperature difference provided by the previous step with a predetermined setpoint value $T^0_{amb\text{-}entry/exit}$;
- of controlling the extraction rate of the extraction means by feedback as a function of the result of this comparison, in order to restore the value of said temperature difference to said setpoint value $T^0_{amb\text{-}entry/exit}$ if necessary.

According to one of the embodiments of the invention, however, the unit 30 is also capable:

- of determining the difference $T_{exit\text{-}entry}$ between the temperature $T_{exit}$ provided by the probe 22 and the temperature $T_{entry}$ provided by the probe 21;
- of comparing the value of the temperature difference provided by the previous step with a predetermined setpoint value $T_{exit\text{-}entry}$; and
- of controlling the orientation of some or all of the equilibration valves 20 by feedback as a function of the result of this comparison, in order to direct some or all of the cold gases contained in the tunnel so as to restore the value of said temperature difference to the setpoint value $T^0_{exit\text{-}entry}$ if necessary.

Although it is possible to manage just the extraction 3 according to the invention, it is clear that the combined use of both control modes (extraction means and valves) offers the best results.

The unit 30 determines the difference $T_{exit\text{-}entry}$ between the temperature $T_{exit}$ (22) and the temperature $T_{entry}$ (21), and compares it with a predetermined setpoint value $T^0_{exit\text{-}entry}$. If the movements of gas are taking place from the front to the rear in the tunnel, then air will be taken in at the entry of the tunnel, so $T_{entry}$ will rise, and cold gases will also be released from the exit of the tunnel and $T_{exit}$ will fall. Overall, the movement of gas from the front to the rear will lead to a reduction in $T_{exit\text{-}entry}$.

A movement of gas from the rear to the front of the tunnel will likewise lead to an increase in $T_{exit\text{-}entry}$.

Inside the tunnel, the gas equilibration valves 20 deviate the turbulence created by the fans and make it possible to direct the cold gases to the entry or exit of the tunnel, according to the requirements.

The invention therefore provides a means of controlling the movements of gas in the tunnel (gas valves) and a means of measuring these movements ($T_{exit\text{-}entry}$). A regulating mechanism then makes it possible to adapt the position of the gas valves continuously as a function of $T_{exit\text{-}entry}$ so as to obtain a stable situation without movement of gas to the front or to the rear. A regulating system of the PID type compares $T_{exit\text{-}entry}$ with a setpoint and calculates the ideal position of the gas valves.

Temperature setpoints which, to a greater or lesser extent, are lower than the ambient temperature will preferably be used—whether for the entry or the exit—and in practice ones that are preferably close to 0° C.

It will be understood from reading the description given above that these control modes operate independently but, in combination, they make it possible to obtain tunnel operation very close to the ideal conditions.

Whatever the case, and without the following schematic explanation (which is purely intended to assist comprehension of the phenomena which may currently be encountered) implying any limitation of the present invention: when the two control modes are combined, there is a sort of exchange of the "problem" between the entry and the exit of the tunnel (to deal with the intermediate "cold ball" lying between the entry and the exit), with the valves being capable of sending this "cold ball" to the entry while the extraction is in turn capable of removing some of it from the tunnel, when this proves necessary.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for operating a cryogenic tunnel through which products to be chilled or deep-frozen pass, which tunnel is equipped with means for injecting a cryogenic fluid as well as means for extracting, at a variable rate, some of the cold gases resulting from the vaporization of said fluid in the tunnel, wherein:

a) obtaining a gas temperature, wherein said gas temperature comprises a value selected from the group consisting of the temperature of the gases in proximity to the entry to the tunnel, and the temperature of the gases in proximity to the exit to the tunnel, wherein said gas temperature is obtained from at least one gas temperature probe which is provided outside the tunnel, at a location selected from the group consisting of proximity to the tunnel entrance, and proximity to the tunnel exit;

b) obtaining an ambient temperature, wherein said ambient temperature is obtained from at least one ambient temperature probe which is provided outside the tunnel;

c) determining a first delta, wherein said first delta is the difference between said ambient temperature and said gas temperature;

d) comparing the value of said first delta with a first setpoint value; and, e) controlling the extraction rate of said extraction means by feedback as a function of the result of the comparison in step d), in order to restore the value of said first delta to said setpoint value if necessary.

2. The operating method of claim 1, wherein two or more said ambient temperature probes are provided, and an a average ambient temperature is obtained therefrom.

3. The operating method of claim 2, wherein an entrance gas temperature is obtained from said gas temperature probe which is located outside the tunnel at a location in proximity to the tunnel entrance, a exit gas temperature is obtained from said gas temperature probe which is located outside the tunnel at a location in proximity to the tunnel exit, and wherein an average gas temperature is the average temperature obtained therefrom.

4. The operating method of claim 3, wherein said first delta is the difference between said average ambient temperature and said average gas temperature.

5. The operating method of claim 1, wherein said feedback is performed by a PID system.

6. The operating method of claim 1, wherein one or more gas equilibration valves are provided inside the tunnel, which are capable of directing the cold gases to the entry or the exit of the tunnel and wherein said equilibration valves can be actuated automatically from outside the tunnel.

7. The operating method of claim 6, further comprising:

f) obtaining an entrance gas temperature, wherein said entrance gas temperature is obtained from at least one gas temperature probe provided outside the tunnel, in proximity to its exit;

g) obtaining an exit gas temperature, wherein said exit gas temperature is obtained from at least one gas temperature probe is provided outside the tunnel, in proximity to its entry;

h) determining a second delta, wherein said second delta is the difference between said entrance gas temperature and said exit gas temperature, i) comparing the value of the said second delta with a second setpoint value; and, j) controlling the orientation of some or all of said equilibration by feedback as a function of the result of the comparison in step h), in order to direct some or all of the cold gases contained in the tunnel so as to restore the value of said temperature difference to said second setpoint value if necessary.

8. The operating method of claim 7, wherein two or more said exit temperature probes are provided, and an average exit temperature is obtained therefrom.

9. The operating method of claim 8, wherein two or more said entrance probes are provide, and an average entrance temperature is obtained therefrom.

10. The operating method of claim 9, wherein said second delta is the difference between said average exit temperature and said average entrance temperature.

11. The operating method of claim 7, wherein said feedback is performed by a PID system.

12. The operating method of claim 1, wherein said extraction means on which the feedback is carried out comprises a single extraction line located inside the tunnel, substantially above the region where the products enter.

13. A device for operating a cryogenic tunnel through which products to be chilled or deep-frozen pass, which tunnel is equipped with means for injecting a cryogenic fluid as well as means for extracting, at a variable rate, some or all of the cold gases resulting from the vaporization of said fluid in the tunnel, comprising:

a) at least one gas temperature probe located outside the tunnel, in proximity to it's a location selected from the group consisting of the tunnel entry and the tunnel exit, wherein said gas temperature probe is capable of providing a gas temperature value, wherein said gas temperature comprises a value selected from the group consisting of the temperature of the gases in proximity to the entry to the tunnel, and the temperature of the gases in proximity to the exit to the tunnel;

b) at least one ambient temperature probe located outside the tunnel, which is capable of providing an ambient temperature value of the premises where the tunnel is operating; and c) a data acquisition and processing unit capable of determining a first delta, wherein said first delta is the difference between said ambient temperature and said gas, of comparing the value of the first delta with a first setpoint value, and of controlling the extraction rate of said extraction means by feedback as a function of the result of said comparison, in order to restore the value of said temperature difference to said first setpoint value if necessary.

14. The operating device of claim 13, wherein two or more said ambient temperature probes are provided, and an a average ambient temperature is obtained therefrom.

15. The operating device of claim 14, wherein an entrance gas temperature is obtained from said gas temperature probe which is located outside the tunnel at a location in proximity to the tunnel entrance, a exit gas temperature is obtained from said gas temperature probe which is located outside the tunnel at a location in proximity to the tunnel exit, and wherein an average gas temperature is the average temperature obtained therefrom.

16. The operating device of claim 15, wherein said first delta is the difference between said average ambient temperature and said average gas temperature.

17. The operating method of claim 13, wherein said feedback is performed by a PID system.

18. The operating device as claimed in claim 13, wherein said operating device further comprises one or more gas equilibration valves inside the tunnel, which are capable of directing the cold gases to the entry or the exit of the tunnel and can be actuated automatically from outside the tunnel.

19. The operating device of claim 17, further comprising:

a) at least one gas temperature probe located outside the tunnel, in proximity to its exit, which is capable of providing an entrance gas, and at least one gas temperature probe located outside the tunnel, in proximity to its entry, which is capable of providing an exit gas temperature; and b) a data acquisition and processing unit capable of determining a second delta, wherein said second delta is the difference between said exit gas temperature and said entrance temperature, of comparing the value of the second delta with a second setpoint value, and of controlling the orientation of some or all of said equilibration valves by feedback as a function of the result of the previous comparison, in order to direct some or all of the cold gases contained in the tunnel so as to restore the value of said second delta to said second setpoint value if necessary.

20. The operating method of claim 19, wherein two or more said exit temperature probes are provided, and an average exit temperature is obtained therefrom.

21. The operating method of claim 20, wherein two or more said entrance probes are provide, and an average entrance temperature is obtained therefrom.

22. The operating method of claim 21, wherein said second delta is the difference between said average exit temperature and said average entrance temperature.

23. The operating method of claim 19, wherein said feedback is performed by a PID system.

24. The operating device as claimed in claim 13, wherein said extraction means on which the feedback is carried out comprise a single extraction line located inside the tunnel, substantially above the region where the products enter.

25. A cryogenic tunnel of the type through which products to be chilled or deep-frozen pass, which is equipped with means for injecting a cryogenic fluid as well as means for extracting, at a variable rate, some or all of the cold gases resulting from the vaporization of said fluid in the tunnel, wherein said cryogenic tunnel comprises an operating device as claimed in claim 13.

* * * * *